US010695790B2

(12) United States Patent
Zalusky et al.

(10) Patent No.: US 10,695,790 B2
(45) Date of Patent: Jun. 30, 2020

(54) DISPOSABLE SEALANT FLUID PATH ASSEMBLY

(71) Applicant: PAR Systems, Shoreview, MN (US)

(72) Inventors: Timothy Zalusky, Little Canada, MN (US); James Cunov, Dellwood, MN (US); Adam Marsh, Forest Lake, MN (US)

(73) Assignee: Par Systems, LLC, Shoreview, MN (US)

( * ) Notice: Subject to any disclaimer, the term of this patent is extended or adjusted under 35 U.S.C. 154(b) by 0 days.

(21) Appl. No.: 16/000,633

(22) Filed: Jun. 5, 2018

(65) Prior Publication Data

US 2018/0345312 A1 Dec. 6, 2018

Related U.S. Application Data

(60) Provisional application No. 62/515,371, filed on Jun. 5, 2017.

(51) Int. Cl.
*B05C 11/10* (2006.01)
*B05C 5/02* (2006.01)
(Continued)

(52) U.S. Cl.
CPC ..... *B05C 11/1002* (2013.01); *B05B 15/62* (2018.02); *B05C 5/0225* (2013.01);
(Continued)

(58) Field of Classification Search
CPC . B05C 11/1002; B05C 5/0225; B05C 5/0229; B05B 15/65
(Continued)

(56) References Cited

U.S. PATENT DOCUMENTS 4,421,146 A 12/1983 Bond et al.
4,613,078 A 9/1986 Marshall
(Continued)

FOREIGN PATENT DOCUMENTS

EP 3133284 A1 2/2017
EP 3155929 A1 4/2017
WO 2015191464 A2 12/2015

OTHER PUBLICATIONS

International Search Report dated Dec. 5, 2018, for corresponding International Application PCT/US2018/036114, filed Jun. 5, 2018.
(Continued)

*Primary Examiner* — Vishal Pancholi
(74) *Attorney, Agent, or Firm* — Steven M. Koehler; Westman, Champlin & Koehler, P.A.

(57) ABSTRACT

One general aspect includes a liquid dispenser with a mount having a mount aperture. A liquid flow path assembly is removably secured to the mount and has an inlet configured to receive liquid, an outlet configured to dispense liquid and a passageway fluidly coupling the inlet to the outlet. A third aperture apart from the inlet and the outlet is fluidly coupled to the passageway and forming a valve guide. The liquid flow path assembly is disposed on the mount to align the third aperture with the mount aperture. An elongated valve has a valve stem guided by the valve guide and extends through the third aperture and the mount aperture. A latch assembly secures the liquid flow path assembly to the mount.

17 Claims, 9 Drawing Sheets

(51) Int. Cl.

| | |
|---|---|
| ***B05C 17/015*** | (2006.01) |
| ***B05B 15/62*** | (2018.01) |
| *B05B 15/522* | (2018.01) |
| *B05C 17/005* | (2006.01) |
| *B05B 1/30* | (2006.01) |

(52) U.S. Cl.
CPC ..... *B05C 5/0229* (2013.01); *B05C 17/015* (2013.01); *B05B 1/306* (2013.01); *B05B 15/5225* (2018.02); *B05C 17/00516* (2013.01)

(58) Field of Classification Search
USPC ..... 222/110
See application file for complete search history.

(56) References Cited

U.S. PATENT DOCUMENTS

| | | | |
|---|---|---|---|
| 5,190,224 | A | 3/1993 | Hamilton |
| 5,465,879 | A | 11/1995 | La et al. |
| 5,931,355 | A | 8/1999 | Jefferson |
| 6,267,302 | B1 | 7/2001 | Huffman |
| 6,698,617 | B1 | 3/2004 | Szymanski |
| 6,840,461 | B1 | 1/2005 | Burke et al. |
| 6,957,748 | B1 | 10/2005 | Erdman et al. |
| 9,724,722 | B2 | 8/2017 | Lessley et al. |
| 10,088,075 | B2 | 10/2018 | Velinov et al. |
| 2015/0182981 | A1 | 7/2015 | Ikushima |
| 2015/0352588 | A1 | 12/2015 | Lessley et al. |
| 2016/0339470 | A1 | 11/2016 | MacIndoe et al. |
| 2017/0051846 | A1 | 2/2017 | Velinov et al. |
| 2017/0106398 | A1 | 4/2017 | Pringle, IV et al. |
| 2018/0311697 | A1 | 11/2018 | MacIndoe et al. |

OTHER PUBLICATIONS

Invitation to Pay Additional Fees and, Where Applicable, Protest Fee, dated Sep. 13, 2018 for corresponding International Patent Application No., PCT/US2018/036114, filed Jun. 5, 2018.

DISPOSABLE SEALANT FLUID PATH ASSEMBLY

CROSS-REFERENCE TO RELATED APPLICATION

This application claims the benefit of U.S. Provisional Patent Application, Ser. No. 62/515,371, filed Jun. 5, 2017, the content of which is incorporated herein by reference in its entirety.

BACKGROUND

The discussion below is merely provided for general background information and is not intended to be used as an aid in determining the scope of the claimed subject matter.

Aspects of the invention relate to liquid dispensers such as dispensers for applying viscous liquid such as but not limited to adhesives and the like. Liquid dispenser assemblies used in automation such as in the production of parts must provide accurate and repeatable delivery of the liquid. When dispensing liquid such as adhesive it is necessary to service the dispenser assembly such as to clean the dispenser particularly when, for instance, there is a delay in operation which would allow the adhesive in dispenser to begin to solidify. Hence, there is a need for an improved liquid dispenser assembly that allows easy cleaning. Apart from this need, there is also a continuing need to provide a dispenser assembly that improves accuracy and repeatability of the amount of liquid dispensed.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

One general aspect includes a liquid dispenser, including: a mount having a mount aperture. The liquid dispenser also includes a liquid flow path assembly removably secured to the mount, the liquid flow path assembly having an inlet configured to receive liquid and an outlet configured to dispense liquid and a passageway fluidly coupling the inlet to the outlet, the liquid flow path assembly including a third aperture apart from the inlet and the outlet fluidly coupled to the passageway and forming a valve guide, the liquid flow path assembly disposed on the mount to align the third aperture with the mount aperture. The liquid dispenser also includes an elongated valve having a valve stem guided by the valve guide and extending through the third aperture and the mount aperture. A latch assembly is configured to secure the liquid flow path assembly to the mount, the latch assembly mounted on one component of the mount or the liquid flow path assembly. The latch assembly includes a movable latch member to releasably engage a securing member on a second component of the mount or the liquid flow path assembly.

Another general aspect includes a liquid dispenser, including: a mount having detachable portions forming an aperture when connected together. The liquid dispenser also includes a liquid flow path assembly removably secured to the mount, the liquid flow path assembly having an inlet configured to receive liquid and an outlet configured to dispense liquid and a passageway fluidly coupling the inlet to the outlet. The inlet is disposed in the aperture where portions of the liquid flow path assembly are engaged by the portions of the detachable portions to secure the liquid flow path assembly to the mount. The liquid dispenser also includes at least one displacement assembly to control movement of at least one of the detachable portions of the mount toward and away from the other detachable portion.

Implementations of the above aspects may include one or more of the following features. The displacement assembly can include an elongated rod joined to one of the detachable portions. Various mechanisms can be used to control movement of the rod such as nut that threadably engages the elongated rod, or in a preferred embodiment, a pivoting lever controls movement of the elongated rod. This allows the detachable portions to be conveniently separated from each other without the use of tools. If desired, a second displacement assembly can be disposed on the mount on an opposite side of the inlet from the displacement assembly so as to have symmetrical mounting forces upon the liquid flow path assembly.

In addition, Implementations may include one or more of the following features if not already provided. In one embodiment, the latch assembly is secured to the mount and the securing member is disposed on the liquid flow path assembly, although in an alternative embodiment the location of these elements can be reversed. The securing member can be detachably coupled to the mount or the liquid flow path assembly. In one embodiment, the liquid flow path assembly includes two separable and mateable portions where a first mateable portion includes the inlet and a second mateable portion includes the outlet. The first mateable portion and the second mateable portion can be joined together to form a portion of the passageway into which the valve stem extends. The securing member can be disposed, for example, on the second mateable portion in this manner, the securing member can secure the second mateable portion to the first mateable portion as well as help secure the liquid flow path assembly to the mount. If desired, securing member includes an elongated portion forming a shield covering at least a portion of the liquid flow path assembly.

In a preferred embodiment, the passageway includes a first portion through which the valve stem extends and a second portion fluidly coupled directly to the first portion and extending away from the first portion toward the inlet. A second longitudinal axis about which liquid flows toward the first portion can form an oblique angle with a longitudinal axis of the valve stem so as to allow easy liquid flow through the liquid flow path assembly. In a preferred embodiment, the second longitudinal axis extends though the inlet. Such an angle forms a fluid path that has an angle of flow greater than 90 degrees. The oblique angle can be an acute angle in a range of about 40 to 85 degrees, or in a further preferable range of about 40 to 60 degrees.

DETAILED DESCRIPTION OF ILLUSTRATIVE EMBODIMENTS

Figure 1:
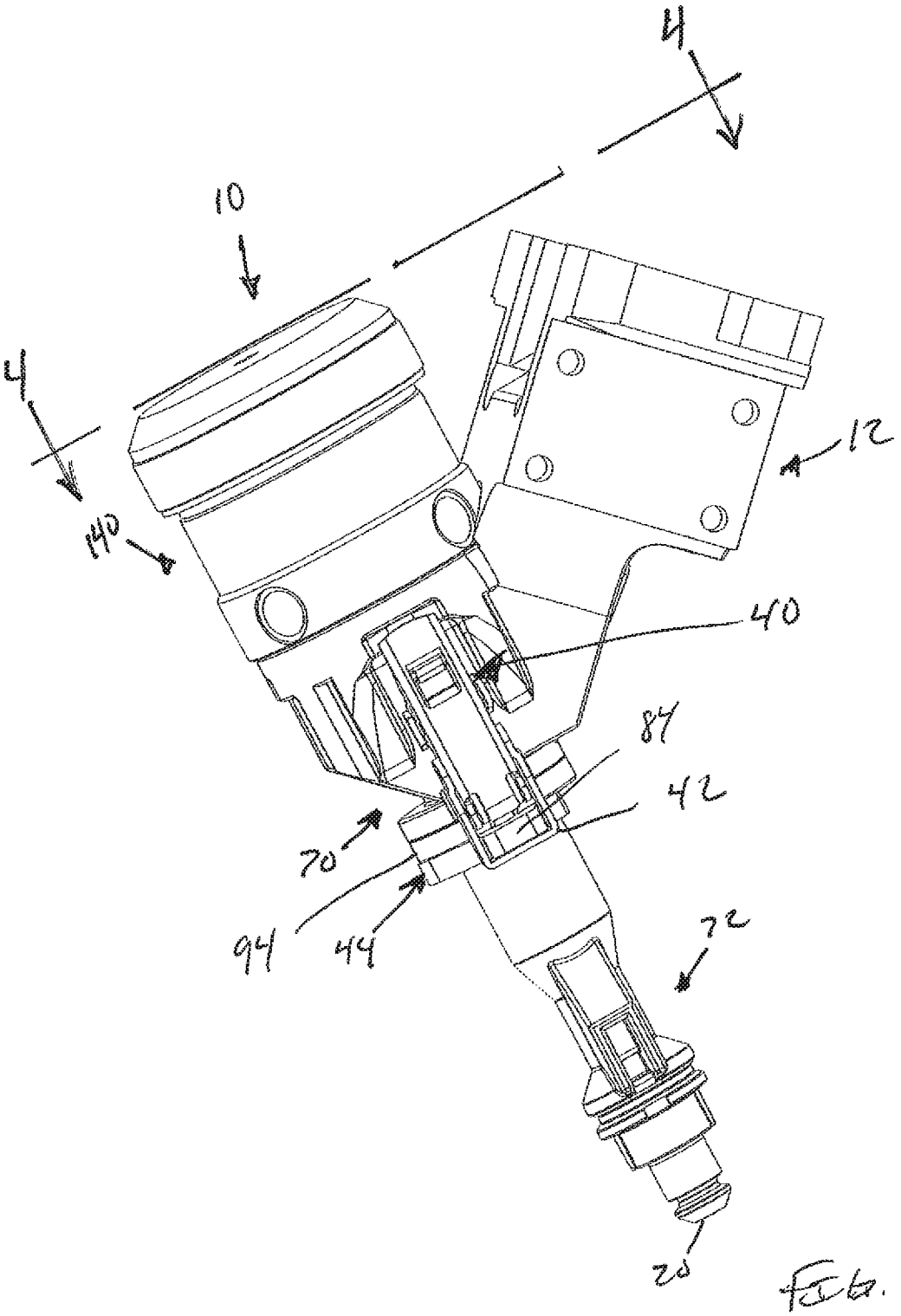
FIG. 1 is a side elevational view of a liquid dispenser.
Figure 2:
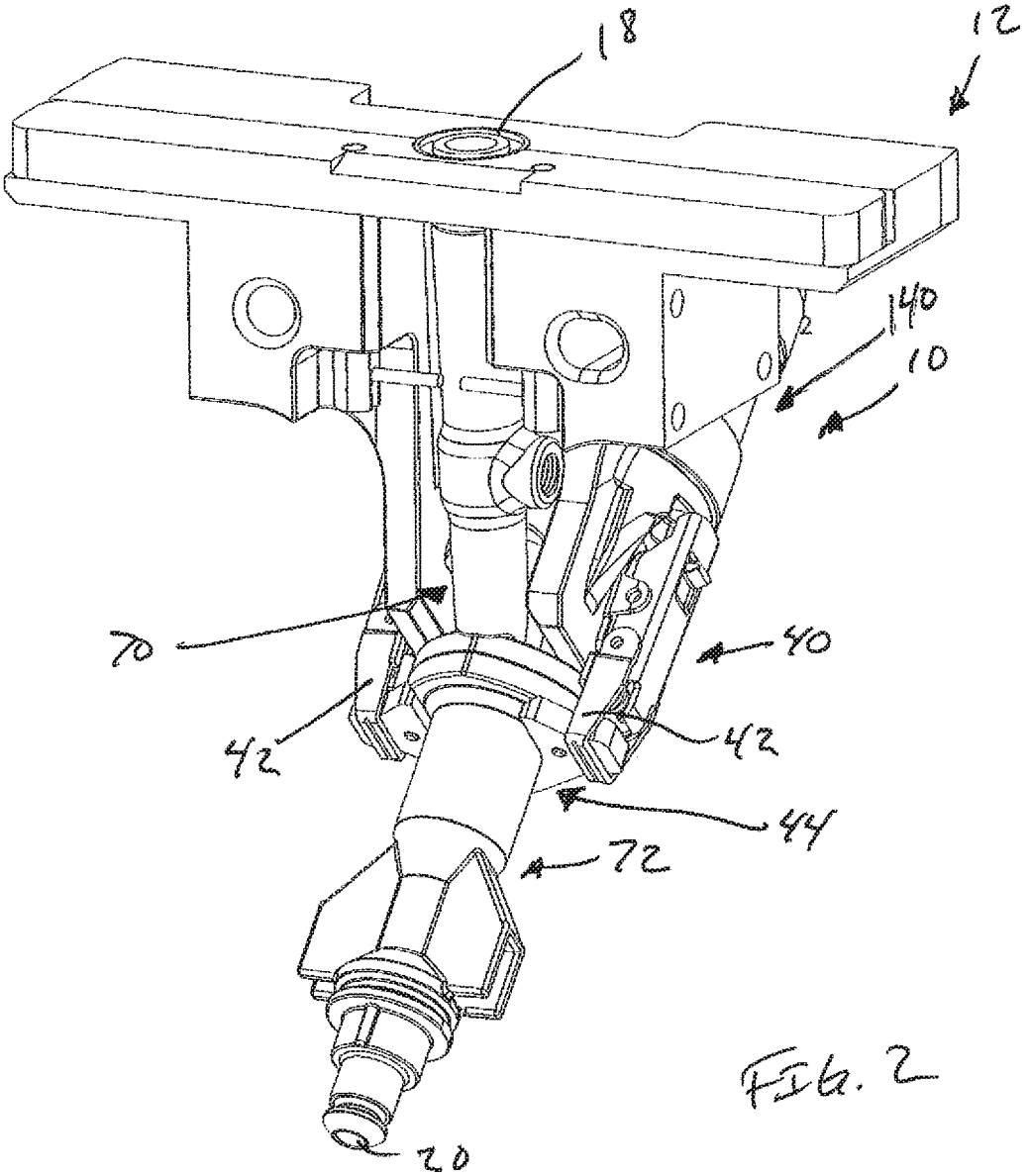
FIG. 2 is a front perspective view of the liquid dispenser.
Figure 3:
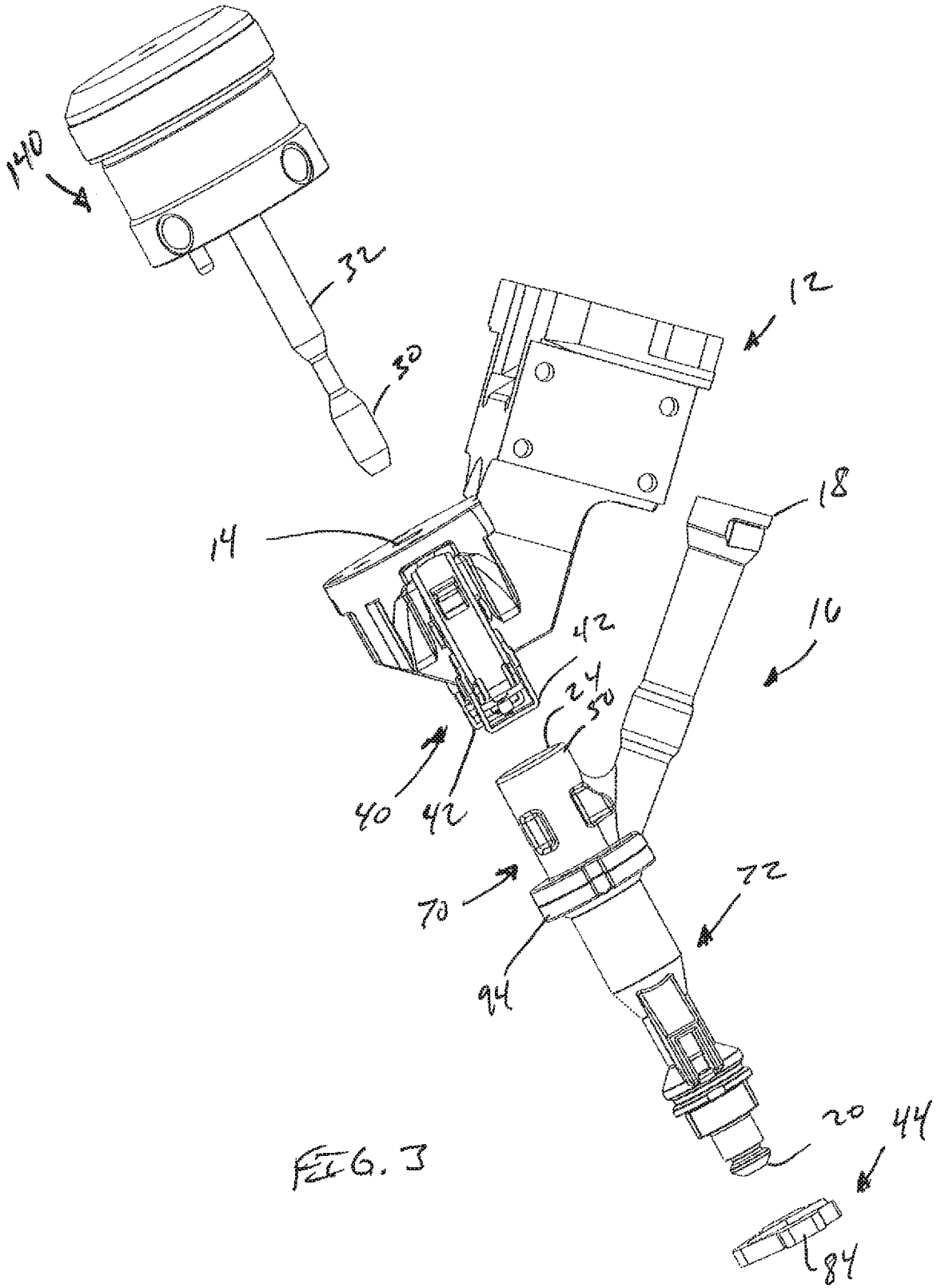
FIG. 3 is an exploded view of the liquid dispenser.

A liquid dispenser 10 is illustrated in the figures. Referring to FIGS. 1-4, the liquid dispenser 10 includes a mount 12 having a mount aperture 14. A liquid flow path assembly 16 is removably secured to the mount 12. The liquid flow path assembly 16 includes an inlet 18 configured to receive liquid and an outlet 20 configured to dispense liquid. A passageway 22 fluidly couples the inlet 18 to the outlet 20. The liquid flow path assembly 16 includes a third aperture 24 apart from the inlet 18 and the outlet 20. The third aperture 24 is fluidly coupled to the passageway 22 and includes a valve guide 26 on an inner surface thereof. The liquid flow path assembly 16 is disposed on the mount 12 to align the third aperture 24 with the mount aperture 14.

An elongated valve 30 controls liquid flow through the liquid flow path assembly 16. The elongated valve 30 includes a valve stem 32 guided by the valve guide 26. The valve stem 32 extends through the third aperture 24 and the mount aperture 14.

A latch assembly 40 is configured to secure the liquid flow path assembly 16 to the mount 12. The latch assembly 40 is mounted on one component comprising the mount 12 or the liquid flow path assembly 16. The latch assembly 40 includes a movable latch member 42 to releasably engage a securing member 44 on a second component of the mount 12 or the liquid flow path assembly 16. In one embodiment as illustrated, the latch assembly 40 with the movable latch member 42 is secured to the mount 12, while the securing member 44 is disposed on the liquid flow path assembly 16. However, it should be understood in an alternative embodiment the latch assembly 40 can be mounted to the liquid flow path assembly 16 where the securing member 44 is then mounted upon on the mount 12.

Figure 4:
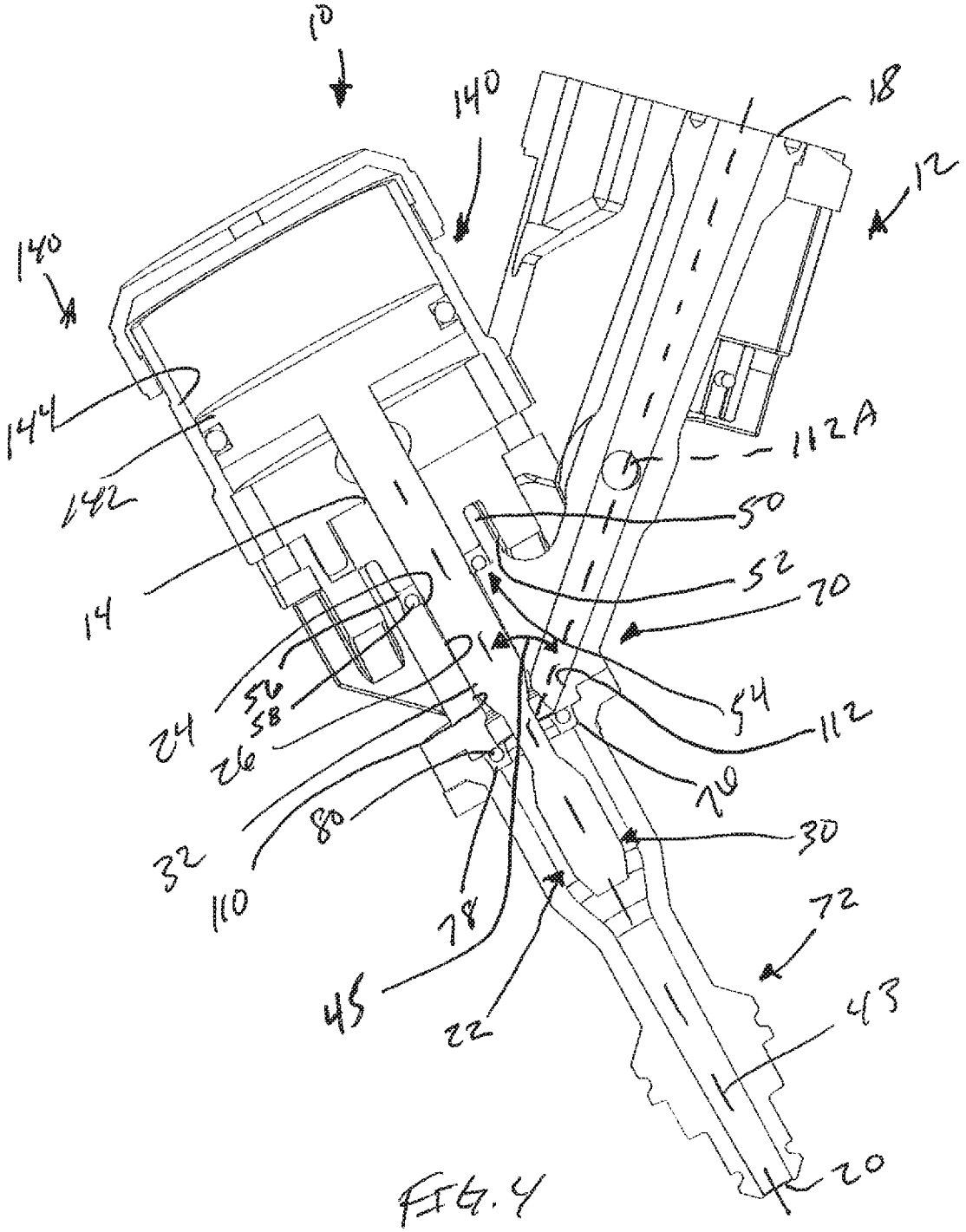
FIG. 4 is a sectional view of the liquid dispenser taken along lines 1-1 in FIG. 1.

As indicated above, the third aperture 24 is aligned with the mount aperture 14. Referring to FIG. 4 if desired cooperating aligning components can be provided between the liquid flow path assembly 16 and the mount 12 so as to easily align the third aperture 24 with the mount aperture 14. In the embodiment illustrated, a projecting member and cooperating recess are provided between the liquid flow path assembly 16 and the mount 12. In particular, the projecting member is disposed on the liquid flow path assembly 16, and in the embodiment illustrated comprises a cylindrical ring 50 that cooperates with a corresponding cylindrical recess 52 provided in the mount 12. A seal 54 is provided between the liquid flow path assembly 16, and the mount 12. In one embodiment, a two-part seal is provided comprising a mount 56 and a ring insert 58.

In the embodiment illustrated, the liquid flow path assembly 16 comprises two separable and mateable portions. A first mateable portion 70 includes the inlet 18, while a second mateable portion 72 includes the outlet 20. The first mateable portion 70 and the second mateable portion 72 include cooperating stepped flanges with aligning members formed therebetween to align the first mateable portion 70 to the second mateable portion 72. A seal 76 is provided and the embodiment illustrated includes a mount 78 and a ring insert 80. The first mateable portion 70 and the second mateable portion 72 are joined together to form a portion of the passageway 22 into which the valve stem 32 extends.

The latch assembly 40 is operable as to pull the liquid flow path assembly 16 toward the mount 12, thereby sealing the liquid flow path assembly 16 to the mount 12 about the third aperture 24. In a preferred embodiment, at least two latch assemblies 40 are provided, preferably disposed on opposite sides, or approximately 180 degrees relative to each other about a longitudinal axis 43 extending through the valve stem 32 and the outlet 20. When embodied as a two-part assembly, the latch member 42 is operable upon the second mateable portion 72 so as to pull the second mateable portion 72 against the first mateable portion 70 to effectuate a seal there between, and also to effectuate the seal between the first mateable portion 70 and the mount 12. Being operable on the second mateable portion 72, the securing member 44 is present on the second mateable portion 72, for example, integrally formed thereon as a single unitary body. In another embodiment though, the securing member 44 is detachably coupled to the liquid flow path assembly 16 (or the second mateable portion 72 if provided as a two-part assembly). In the embodiment illustrated, the securing member 44 includes ears 84 configured so as to align with the moveable latch member 42 or each of the latch assemblies 40. In the embodiment illustrated, the securing member 44 includes a recess 90 with an opening 92 of size to receive the liquid flow path assembly 16 therein. In this matter, the securing member 44 can be easily decoupled from the liquid flow path assembly 16. The liquid flow path assembly 16 includes an outwardly extending flange 94 (herein provided on the second mateable portion 72) that the securing member 44 can butt against when the movable latch members 42 engage each corresponding ear 84 and the latch assemblies 40 are operated so as to pull the liquid flow path assembly 16 against the mount 12.

Figure 5:
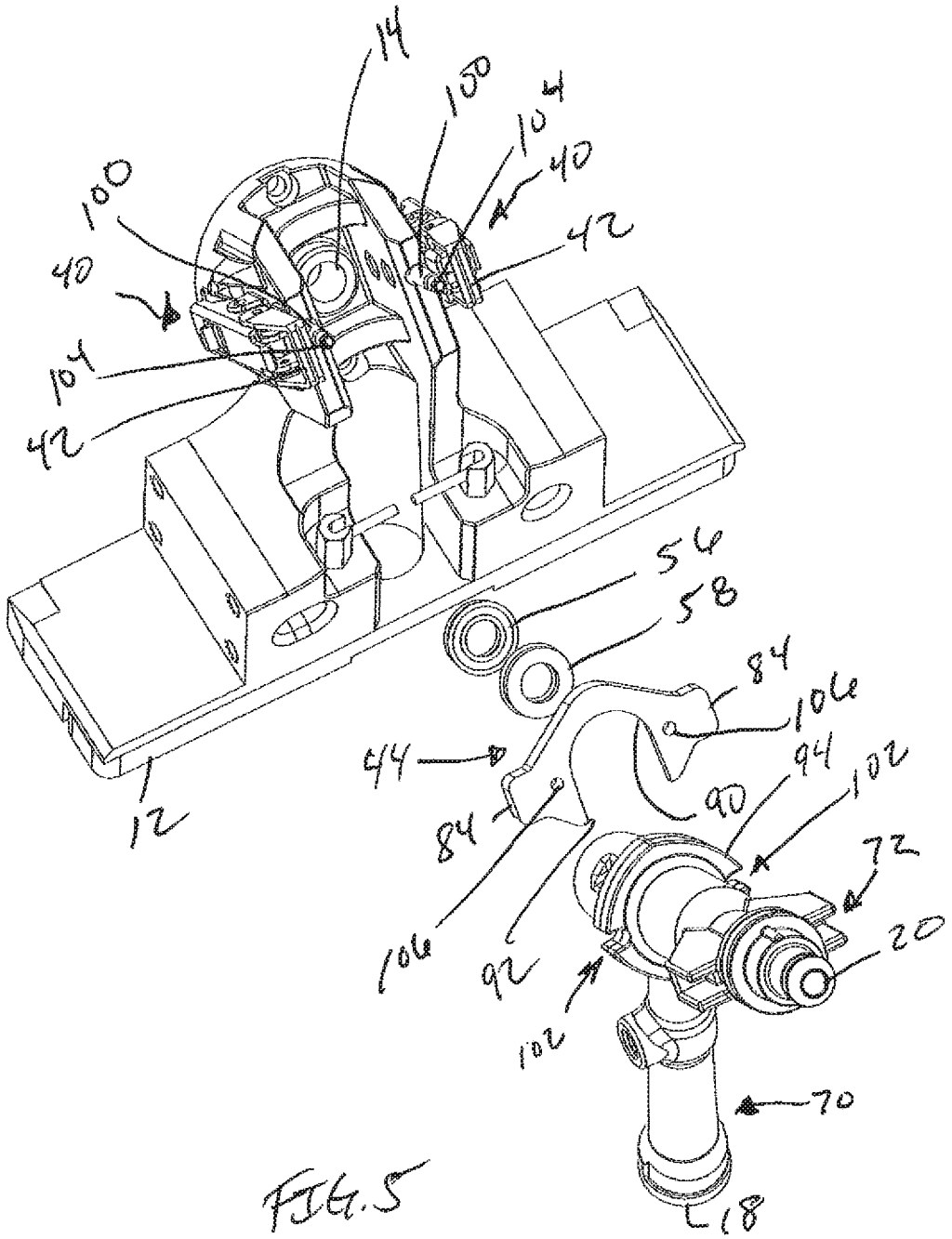
FIG. 5 is a second exploded view of the liquid dispenser.
Figure 6:
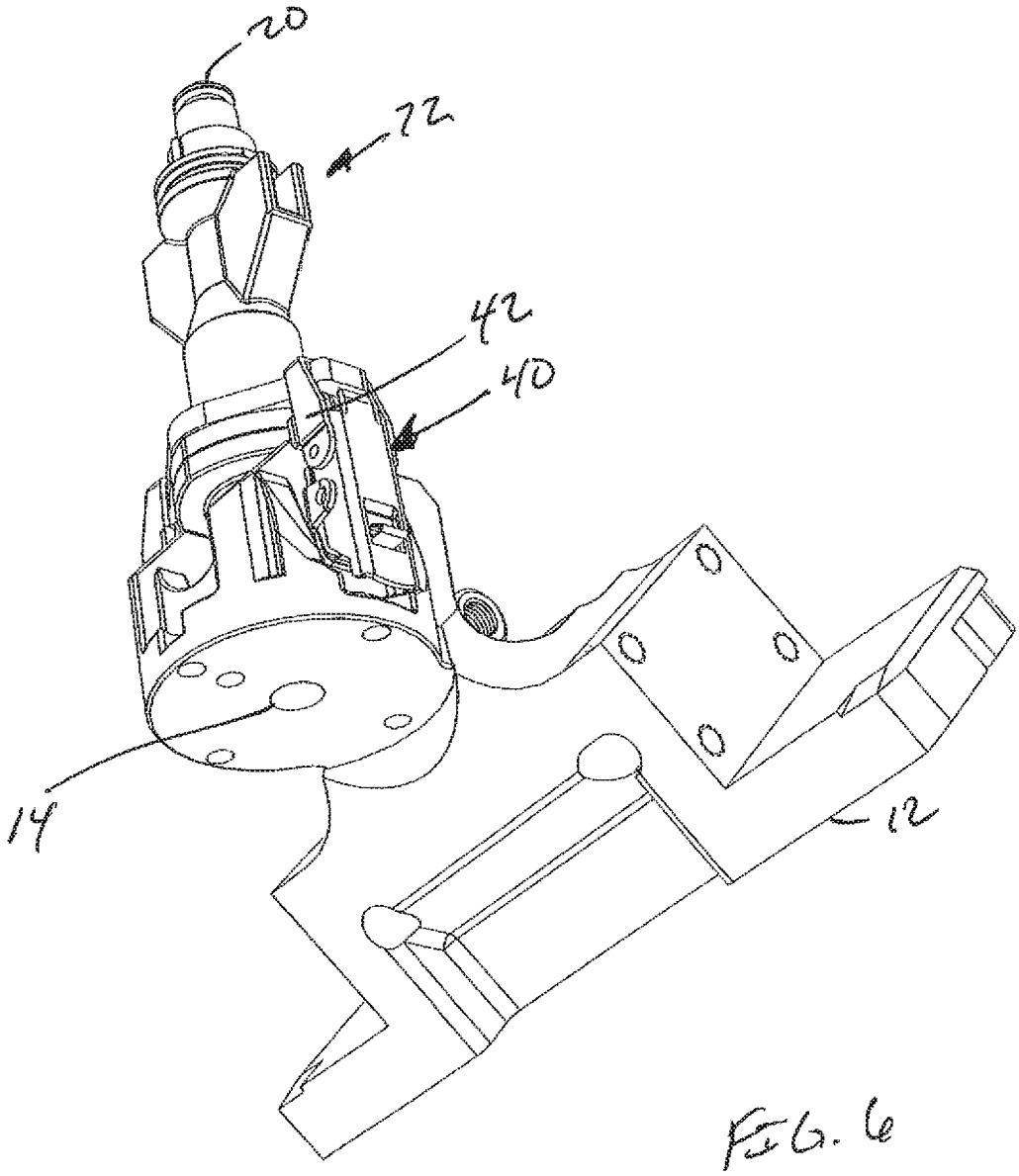
FIG. 6 is rear perspective view of the liquid dispenser with parts removed.

Referring to FIG. 5, one or more alignment pins 100 can be provided on the mount 12. The alignment pin(s) 100 engage one or more corresponding recesses 102 provided on the liquid flow path assembly 16. In the embodiment illustrated where the liquid flow path assembly 16 includes portions 70 and 72, each of the portions 70 and 72 include recesses that align with each other to form each recess 102. Thus, in such a two-part assembly, the alignment pins 100 and recesses 102 align the first mateable portion 70 with the second mateable portion 72, and also align the combined assembly with the mount 12. Ends 104 of the alignment pins 100 can engage recesses or apertures 106 provided in the securing member 44.

Referring to FIG. 4, the passageway 22 comprises a first portion 110 through which the valve stem 32 extends and a second portion 112 fluidly coupled directly to the first portion 110 and extending away from the first portion 110 toward the inlet 18. In an advantageous embodiment, the second portion 112 that is directly adjacent to the first portion 110 is arranged so that a second longitudinal axis 112A of the second portion 112 about which liquid flows toward the first portion 110 forms an oblique angle 45 with the longitudinal axis 43 of the valve stem 32. The oblique angle allows liquid flow between the second portion 112 and the first portion 110 to flow easily. In a preferred embodiment, the oblique angle is an angle in the range of about 40 to 85 degrees, while in yet a further preferred embodiment, the oblique angle is an acute in the range of about 40 to 60 degrees. Preferably, the second portion 112 extends from the first portion 110 along a straight or substantially straight flow path. In a preferred embodiment, the second longitudinal axis 112A extends through the inlet 18.

An actuator 140 is operably coupled to the valve 30 to cause control displacement in at least one direction. In the embodiment illustrated, the actuator 140 is pneumatic having a movable piston 142 secured to the valve 30. The piston 142 is slidably disposed in a cylinder 144. Selective pressurization of one or more chambers on opposite sides of the piston 142, controls movement of the piston 142 relative to the cylinder 144 and thus movement of the valve 30. If desired, one or more springs can be provided and coupled to the piston 142 and or valve 30 to aid in the movement in at least one direction.

Using the latch assembly 40, the liquid flow path assembly 16 can be easily removed from the mount 12 when desired allowing quick disassembly and cleaning, if necessary of the valve 30 and/or the liquid flow path assembly 16. In one embodiment, the liquid flow path assembly 16 is replaceable when necessary. When embodied as a two-part assembly, the second portion 72 can be replaced as necessary when different size outlet openings 20 are needed.

Figure 7:
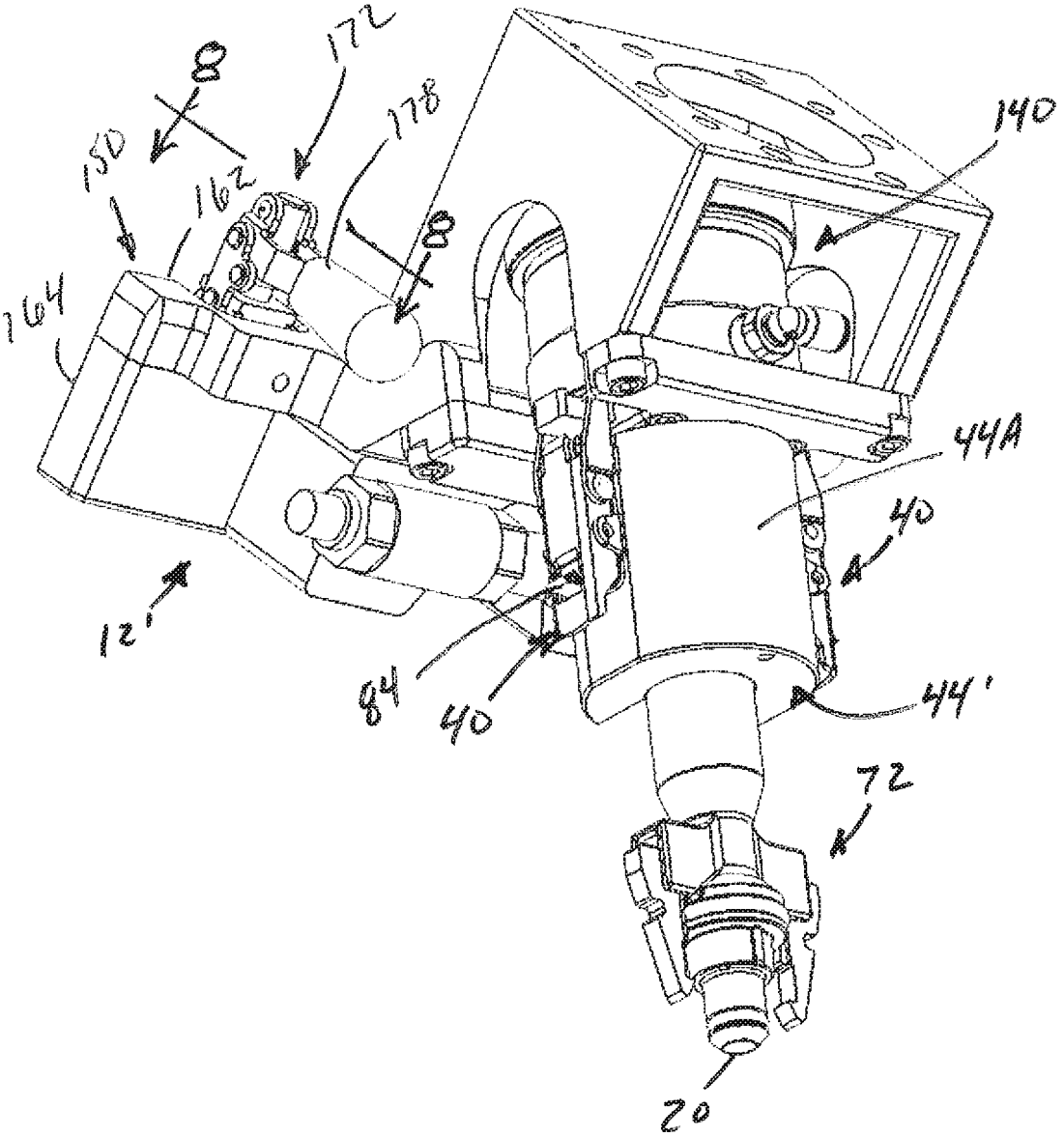
FIG. 7 is front perspective view of a second embodiment of a liquid dispenser.
Figure 8:
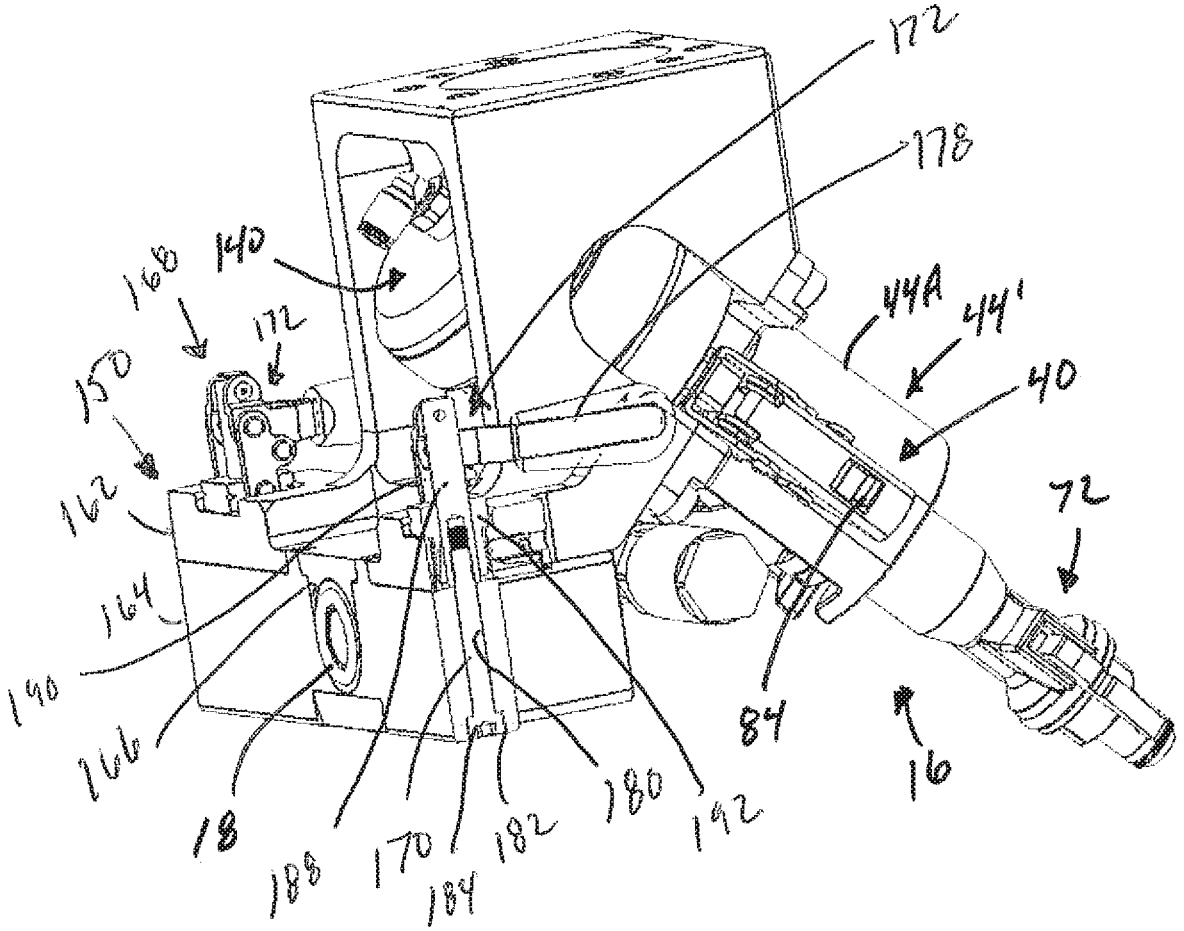
FIG. 8 is a sectional view of the liquid dispenser taken along lines 8-8 in FIG. 7.
Figure 9:
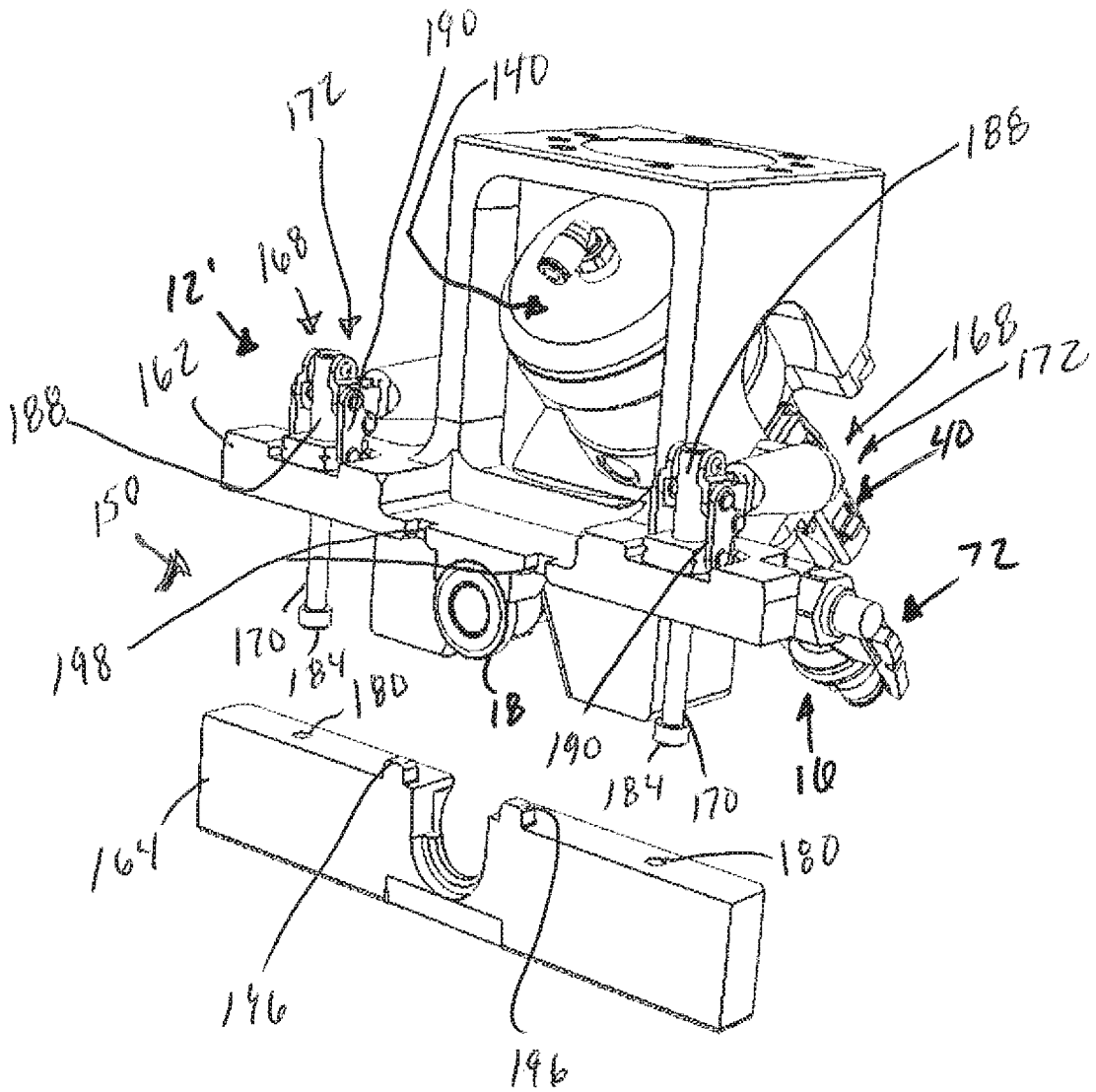
FIG. 9 is an exploded view of the liquid dispenser of FIG. 7.

FIGS. 7-9 illustrate a second embodiment of a liquid dispenser 10'. Many of the components are similar if not the same as the liquid dispenser 10 where some of the like components have been identified with the same reference numbers. The liquid dispenser 10' includes a securing member 44' that includes an elongated portion 44A that can function as a shield if needed to protect a portion of the liquid flow path assembly. In this embodiment, the ears 84 of which the latch assemblies 40, are secured to the elongated portion 44A.

This embodiment also illustrates that the mount 12' can also include a detachable assembly 150 that is used to removably secure a portion of the liquid fluid path assembly 16, and in particular, that portion proximate the inlet 18 so as to be fixedly secured to the mount 12'. In the embodiment illustrated, the detachable assembly 150 includes a first portion 162 of the mount 12' forming a base member. A second portion 164 is movable away from the first portion 162. Together the first portion 162 and the second portion 164 collectively comprise detachable portions and form an aperture 166 that receives a portion of the liquid flow path assembly proximate the inlet 18. A fastening mechanism 168 releasably secures the second portion 164 to the first portion 162. The fastening mechanism 168 can take a number of forms including bolts, clamps, latches and the like. In the embodiment illustrated, the fastening mechanism 168 comprises a slidable rod 170 that is joined at one end to the second portion 164 and controls movement of the second portion 164 to and away from the first portion 162. A displacement assembly or mechanism 172 controls movement of the rod 170. The displacement assembly 172 can take any number of forms such as a nut if the elongated rod 170 includes a threaded portion to receive the rod 170. In the embodiment illustrated an end of the rod remote from the second portion 164 includes a pivoting lever 178.

FIG. 8 illustrates connection of the pivoting lever 178 to the rod 170. The rod 170 extends through a bore 180 having an enlarged recess 182. The rod 170 is inserted through the recess 182 so that an enlarged end 184 abuts the inner wall of the recess 182. An end 184 of the rod 170 threadably engages a control member 188 that is pivotally connected to the lever 178. The pivoting lever 178 is also pivotally connected to a support 190. In a preferred embodiment, the support 190 is adjustably secured to the mount 12' herein using a threaded coupler 192 that is threaded into mount 12'. Adjusting the depth of the coupler 192 in the mount 12' and/or the threaded engagement of the rod 170 with control member 188 allows the travel of the rod 170 to be adjustable, thus allowing adjustment of the extent of movement of the second portion 164 from the first portion 162. In a preferred embodiment, a displacement assembly 172 is provided on opposite sides of the inlet 18.

To remove the liquid flow path assembly 16 from the mount 12' the latch assemblies 40 are operated so as to release and allow removal of the securing member 44 or 44'. Before or after operation of the latch assemblies 40, the displacement assembly(s) 172 are operated so as to allow the second portion 164 to separate from the first portion 162, thereby allowing removal of the portion of the liquid flow path assembly 16 having the inlet 18 to be removed easily from the mount 12'. Reinstallation of the liquid flow path assembly 16 is accomplished in reverse order that being after positioning the liquid flow path assembly 16 in the mount 12' so that the inlet is aligned with the portions 162 and 164, the displacement assemblys 172 and the latch assemblies are operated so as to displace the second portion 164 and the securing member 44 or 44', respectively. It should be noted projections and complimentary recesses formed on the first portion 162 and the second portion 164 can be provided so as to maintain proper alignment between the portions 162 and 164. Herein by way of example, projections 196 are provided on the second portion 164, while complementary recesses 198 are provided on the first portion 162. Of course, location of the projection and the recess on the portions 162 and 164 for one or both of each complimentary pair can be reversed if desired.

Although the subject matter has been described in language specific to structural features and/or methodological acts, it is to be understood that the subject matter defined in the appended claims is not necessarily limited to the specific features or acts described above as has been held by the courts. Rather, the specific features and acts described above are disclosed as example forms of implementing the claims.

What is claimed is:

1. A flowable material dispenser, comprising:

a mount having detachable portions forming an aperture in a surface of the mount when connected together;

a flow path assembly removably secured to the mount, the flow path assembly having an inlet configured to receive flowable material and an outlet configured to dispense flowable material and a passageway fluidly coupling the inlet to the outlet, the inlet being removably disposed in the aperture so as to open to the surface wherein portions of the flow path assembly are engaged by the detachable portions to secure the flow path assembly to the mount, and wherein the flow path assembly includes a third aperture apart from the inlet and the outlet fluidly coupled to the passageway and forming a valve guide, the flow path assembly disposed on the mount to align the third aperture with the aperture in the mount;

at least one displacement assembly to control movement of at least one of the detachable portions of the mount toward and away from the other detachable portion;

an elongated valve having a valve stem guided by the valve guide and extending through the third aperture and the aperture in the mount; and a latch assembly configured to secure the flow path assembly to the mount, the latch assembly mounted on one component comprising the mount or the flow path assembly, the latch assembly having a movable latch member to releasably engage a securing member on a second component of the mount or the flow path assembly.

2. The dispenser of claim 1 wherein the displacement assembly includes an elongated rod joined to one of the detachable portions.

3. The dispenser of claim 2 wherein the displacement assembly includes a pivoting lever to control movement of the elongated rod.

4. The dispenser of claim 3 and further comprising a second displacement assembly disposed on the mount on an opposite side of the inlet from the displacement assembly.

5. The dispenser of claim 1 wherein the detachable portions comprise a first portion detachably coupled to a second portion, wherein the first portion defines a first portion of a perimeter of the aperture and the second portion defines a second portion of the perimeter of the aperture.

6. The dispenser of claim 1 wherein the latch assembly is secured to the mount and the securing member is disposed on the flow path assembly.

7. The dispenser of claim 1 wherein the securing member is detachably coupled to the mount or the flow path assembly.

8. The dispenser of claim 1 wherein the flow path assembly comprises two separable and mateable portions.

9. The dispenser of claim 8 wherein a first mateable portion includes the inlet and a second mateable portion includes the outlet.

10. The dispenser of claim 9 wherein the first mateable portion and the second mateable portion are joined together to form a portion of the passageway into which the valve stem extends.

11. The dispenser of claim 10 wherein the securing member is disposed on the second mateable portion.

12. The dispenser of claim 11 wherein the securing member includes an elongated portion forming a shield covering at least a portion of the flow path assembly.

13. The dispenser of claim 1 wherein the passageway comprises a first portion through which the valve stem extends and a second portion fluidly coupled directly to the first portion and extending away from the first portion toward the inlet, wherein a second longitudinal axis about which the flowable material flows toward the first portion forms an oblique angle with a longitudinal axis of the valve stem.

14. The dispenser of claim 13 wherein the oblique angle is an acute angle in a range of about 40 to 85 degrees.

15. The dispenser of claim 13 wherein the oblique angle is an acute angle in a range of about 40 to 60 degrees.

16. The dispenser of claim 13 wherein second longitudinal axis extends though the inlet.

17. The dispenser of claim 1 and an actuator coupled to the valve stem to axially displace the valve stem along a longitudinal valve stem axis in at least one direction.

* * * * *